United States Patent [19]

White

[11] Patent Number: 4,634,067

[45] Date of Patent: Jan. 6, 1987

[54] HOLDER FOR TOILET PAPER AND PAPER TOWEL ROLLS

[76] Inventor: Roy L. White, Rte., 4, Box 166 K, P.O. #1205, Douglas, Ga. 31533

[21] Appl. No.: 697,724

[22] Filed: Feb. 4, 1985

[51] Int. Cl.[4] ..... A47K 10/32; A47K 10/04

[52] U.S. Cl. ..... 242/55.2; 242/55.3

[58] Field of Search ..... 242/55.2, 55.3, 55.53; 225/34, 46, 47

[56] References Cited

U.S. PATENT DOCUMENTS

| | | | |
|---|---|---|---|
| 1,187,705 | 6/1916 | Calvert | 242/55.2 |
| 1,229,430 | 6/1917 | Farrell | 242/55.2 |
| 1,625,190 | 4/1927 | Boynton | 242/55.2 |
| 1,987,154 | 1/1935 | Noffsinger | 242/55.2 |
| 2,500,514 | 3/1950 | Bozoti | 242/55.2 |
| 3,272,448 | 9/1966 | Caravella | 242/55.2 |
| 3,643,884 | 2/1972 | Curtin | 242/55.2 |
| 4,452,403 | 6/1984 | Arronte | 242/55.2 |

FOREIGN PATENT DOCUMENTS

| | | | |
|---|---|---|---|
| 920422 | 9/1959 | United Kingdom | 242/55.2 |

*Primary Examiner*—Donald Watkins

*Attorney, Agent, or Firm*—John B. Dickman, III

[57] ABSTRACT

A roll tissue dispenser having resilient members for supporting a roll of tissue by its center tube thus making a simple, easy loading and unloading device of this type.

1 Claim, 5 Drawing Figures

HOLDER FOR TOILET PAPER AND PAPER TOWEL ROLLS

BACKGROUND OF THE INVENTION

The well known toilet tissue dispenser is a U-shaped bracket having a wall attaching portion and a pair of projecting arms. A roller with spring biased ends snap into depressions in the arms. A holder of this type accepts rolls of tissue which generally have a cardboard cylindrical tube through which the roller is inserted such that the spring biased end project beyond the roll to snap into the depressions in the holder arms.

Another commonly used tissue dispenser is also a U-shaped bracket with a wall attaching portion and projecting arms. Instead of a roller, the arms are spring biased and hinged where they attach to the wall portion. Each arm has an inwardly facing projection which fits into the cylindrical tube of a roll of tissue. To install a roll of tissue, the arms are biased outwardly and the projections are snapped into the cylindrical tube.

The inventor is aware of U.S. Pat. No. 2,500,514, entitled, Paper Roll Holder. A roller with spring biased ends supports a roll of tissue on the holder in one embodiment. In the other embodiment, spring biased plunger rods hold a tube between the arms. A roll of tissue is slipped on the tube and then the plunger rolls fit in the tube.

Each of the described tissue dispensers has been serviceable over the years, however, the problem of replacing a roll of tissue in the holder has led to the present invention. The prior art holders require at least two steps to install a roll of tissue, and in most cases, it seems next to impossible. Therefore, the object of this invention is to provide a one step process for loading a roll of tissue on the holder.

SUMMARY OF THE INVENTION

The present invention relates to a tissue dispenser for bathroom tissue or paper towles, and in particular, to a tissue holder with limited moving parts for loading a roll of tissue. In the general mode of the invention, the tissue dispenser has a pair of projecting arms which extend from a wall and are spaced at a distance from one another to accept a roll of tissue. Each arm has an inwardly facing coil spring or a similar resilient member which fits in the cardboard tube of a roll of tissue. When a roll of tissue is inserted in the holder, the coil springs flex to allow the tube to align between the springs with a spring fitting into each end of the tube.

In one embodiment, the projecting arms are integral with a wall bracket to form a U-shaped holder. While in the other embodiment, the arms have their own wall mounting elements which allows the arms to be spaced at any comfortable distance.

The main object of this invention is to provide a tissue dispenser for rolls of tissue which has an easy to use method for installing rolls of tissue.

An object is to provide a tissue dispenser that does not allow the roll of tissue to freely spin thereby wasting tissue.

Because of the simple and straightforward design of the tissue dispenser, it is another object to provide a tissue dispenser that is inexpensive to manufacture.

DESCRIPTION OF THE INVENTION

Figure 1:
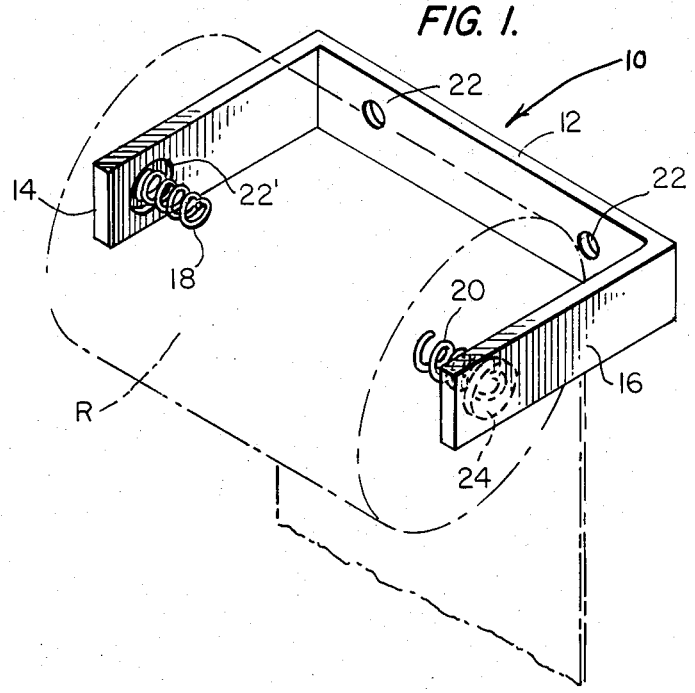
FIG. 1 is a perspective view of one embodiment of the tissue dispenser of this invention.
Figure 3:
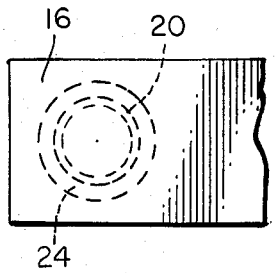
FIG. 3 is a fragmentary side view of the tissue dispenser in FIG. 1.
Figure 2:
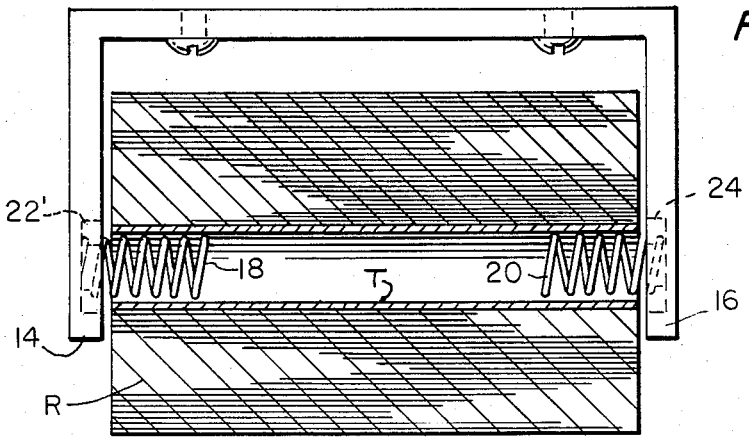
FIG. 2 is a top plan view of the tissue dispenser shown in FIG. 1.

Referring to the drawings, there is shown in FIGS. 1 to 3 a preferred embodiment of the invention. The tissue dispenser 10 is a U-shaped structure with a wall mounting bracket 12 and a pair arms 14 and 16 at right angles to the bracket. Each arm has a coil spring 18 and 20, respectively, molded in the arm to project inwardly, as shown in FIGS. 1, 2 and 3. The bracket 12 has a pair of screw holes 22 for attaching the tissue dispenser 10 to a wall.

In FIGS. 1 and 2, a roll of tissue R is shown supported by the coil springs 18 and 20. To install the roll R, the cardboard cylindrical tube, T, in the center of the roll is fitted on the springs 18 and 20. By pressing the roll R between the arms 14 and 16, the coil springs 18 and 20 flex until the tube is in place. At which point, the coil springs 18 and 20 snap into the tube, and are smaller in diameter than recesses 22' and 24.

By squeezing the tube to change its cross-sectional shape from round to oblong, the tissue can be payed from the roll R at a controlled rate. That is, the roll R will not freely rotate on the coil springs 18 and 20. In fact, without squeezing the tube the roll R will not rotate as freely as it would on a roller found in most tissue holders. This is because as the roll turns the weight is not evenly supported around the coil springs, causing a drag on the roll's rotation.

Manufacturing the tissue dispenser 10 may use a molding technique where the entire holder is integrally formed, or an assembly procedure where each arm is welded or attached in some manner to the bracket 12. In either manufacturing method, the coil springs can be molded directly with the arms, or each arm can be bored and the coil springs bonded in the bores. Since plastics and metals are simple to mold it is preferred to use a molding technique. However, it is possible to make wooden dispensers in one piece or assembled pieces. There are obviously a wide range of materials and manufacturing methods which can be used.

Figure 4:
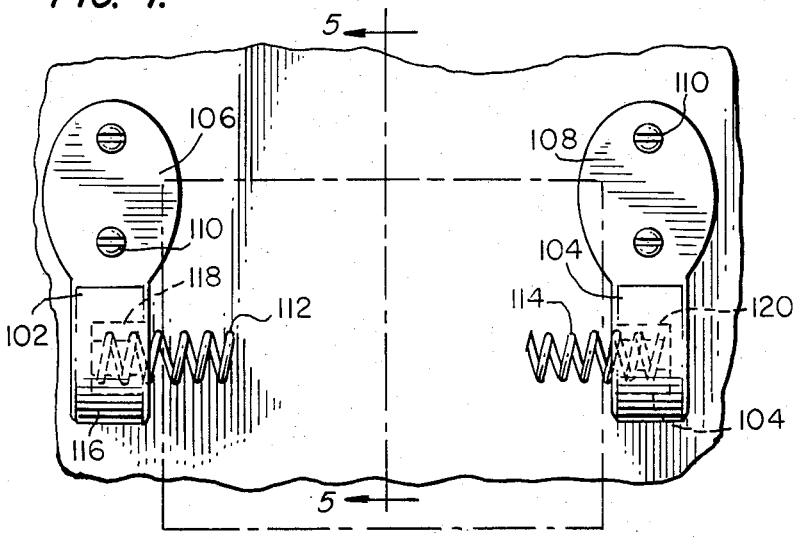
FIG. 4 is a front plan view of another embodiment of a tissue dispenser of this invention.
Figure 5:
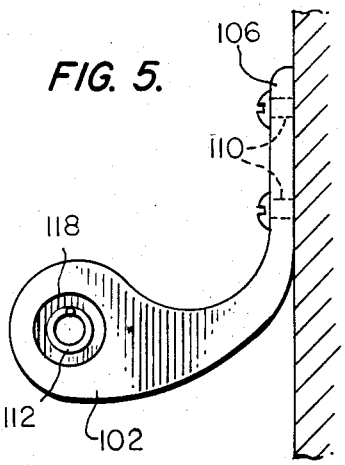
FIG. 5 is a side plan view of the device taken along the line 5—5 of FIG. 4.

Turning to FIGS. 4 and 5, the tissue dispenser 100 in this embodiment is made with two separate arms 102 and 104. Each arm has its own wall bracket portion 106 and 108 integrally formed with the arm. There are screw mounting holes 110 in the brackets for attaching the dispenser to a wall. The coil springs 112 and 114 are fixed to the arms 102 and 104 so that when the tissue dispenser 100 is mounted on a wall, they face each other. FIG. 4 shows one of the arms, 102, with a large knob end 116 and coil spring 112 fixed in the knob, recesses 118, 120 larger than springs.

With the separate arms and wall brackets of this embodiment, the tissue dispenser 100 can be adjusted to accommodate any size roll. For example, the same pair of arms 102 and 104 can be used as a holder for toilet tissue or paper towels even though the towels are much wider.

Installing a roll of tissue on dispenser 100 is exactly the same as described in the first embodiment.

While two embodiments of the invention have been disclosed, it is understood that one skilled in the art could make changes in the invention without changing the inventive concept. Therefore, one should study the drawings and the specification together with the claims to fully understand the invention. There is one simple illustration where changing the coil springs for resilient elements of rubber or similar materials would not change the invention.

I claim:

1. A roll tissue dispenser for paying sheets of tissue from a roll of tissue of the type having a center tube, comprising at least one wall mounting means, a pair of projecting arms extending from said wall mounting means, circular recesses in said arms facing each other inwardly, said recesses each having a bottom portion and upstanding side walls, resilient double ended coil spring means of smaller outer diameter than the innder diameter of said recess side walls in said arms affixed to the bottom of the circular recesses at one of their ends and having their free ends facing each other, the outer diameter of said coil spring means being slightly smaller than the inner diameter of the center tube and adapted to bind directly thereagainst when said tube and said roll are slightly deformed whereby free rotation of said roll on said coil springs is prevented.

* * * * *